US008317525B2

(12) United States Patent
Bayerer

(10) Patent No.: US 8,317,525 B2
(45) Date of Patent: Nov. 27, 2012

(54) PRESS-FIT CONNECTIONS FOR ELECTRONIC MODULES

(75) Inventor: Reinhold Bayerer, Warstein (DE)

(73) Assignee: Infineon Technologies AG, Neubiberg (DE)

( * ) Notice: Subject to any disclaimer, the term of this patent is extended or adjusted under 35 U.S.C. 154(b) by 0 days.

(21) Appl. No.: 13/053,810

(22) Filed: Mar. 22, 2011

(65) Prior Publication Data

US 2011/0256749 A1 Oct. 20, 2011

(30) Foreign Application Priority Data

Mar. 26, 2010 (DE) ..... 10-2010-003367

(51) Int. Cl.
*H01R 12/00* (2006.01)

(52) U.S. Cl. ..... 439/75

(58) Field of Classification Search ..... 439/75, 439/80, 81, 82, 74
See application file for complete search history.

(56) References Cited

U.S. PATENT DOCUMENTS

| | | | | |
|---|---|---|---|---|
| 4,446,505 | A * | 5/1984 | Long et al. | 361/785 |
| 5,373,626 | A * | 12/1994 | Youngfleish | 29/739 |
| 5,761,050 | A * | 6/1998 | Archer | 361/791 |
| 6,305,949 | B1 * | 10/2001 | Okuyama et al. | 439/75 |
| 2008/0019110 | A1 * | 1/2008 | Gilliland et al. | 361/810 |

* cited by examiner

*Primary Examiner* — Ross Gushi
(74) *Attorney, Agent, or Firm* — Murphy, Bilak & Homiller, PLLC

(57) ABSTRACT

A press-fit connecting element for being pressed into a first contact opening in a first connection element and into a second contact opening in a second connection element is provided. The press-fit connecting element includes an elongated base body configured to be guided through the second contact opening in the second connection element to the first contact opening in the first connection element. The press-fit connecting element further includes a first press-fit zone configured to contact-connect the first contact opening in a force-fitting manner and a second press-fit zone which is at a distance from the first press-fit zone in a longitudinal direction and configured to contact-connect the second contact opening in a force-fitting manner.

10 Claims, 9 Drawing Sheets

FIG 1A - PRIOR ART
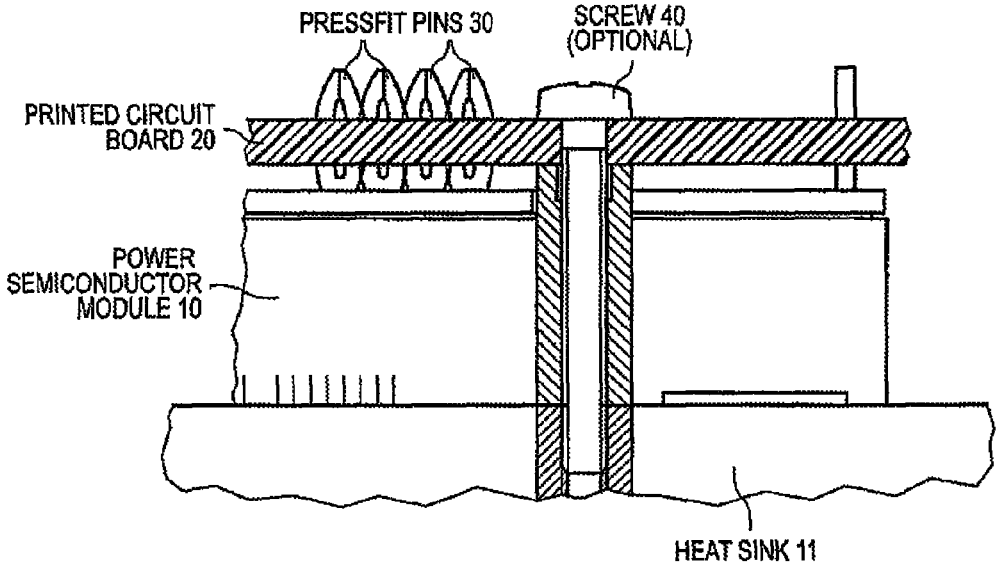
FIG 1B - PRIOR ART
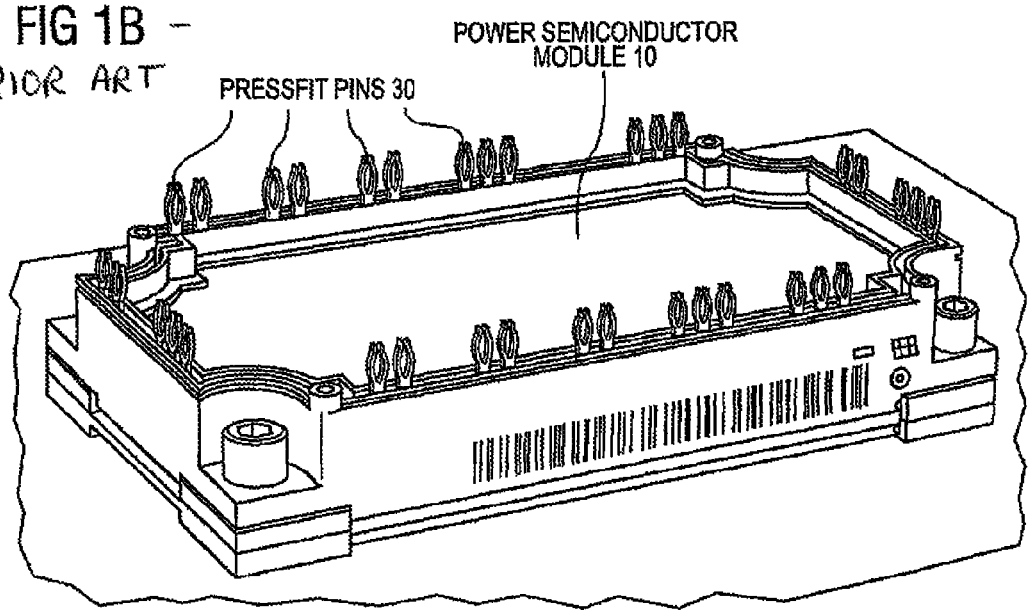

FIG 10
a)
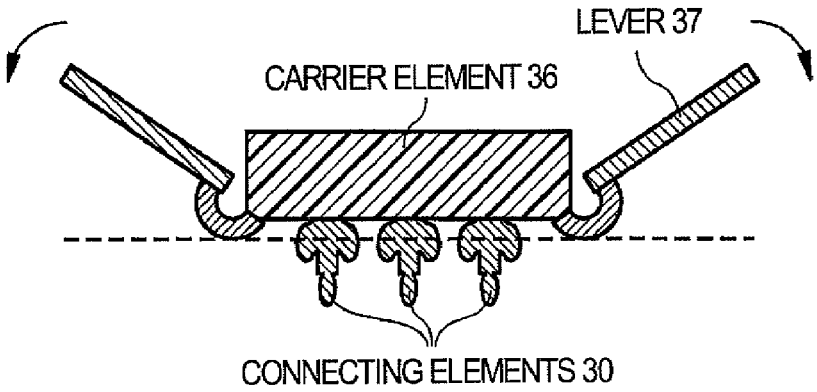
b)
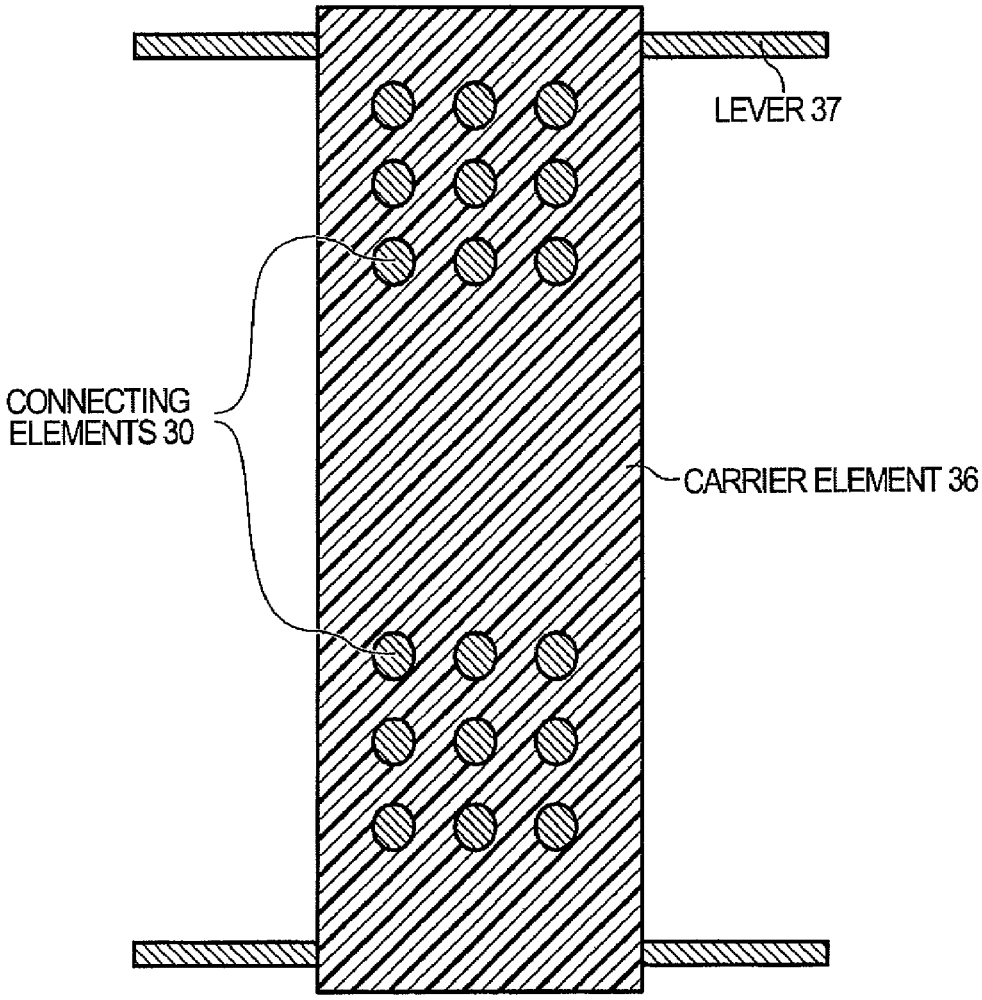

PRESS-FIT CONNECTIONS FOR ELECTRONIC MODULES

PRIORITY CLAIM

This application claims priority to German Patent Application No. 10 2010 003 367.7 filed on 26 Mar. 2010, the content of said application incorporated herein by reference in its entirety.

TECHNICAL FIELD

The present application relates to press-fit connections for connecting electronic modules such as power semiconductor modules to printed circuit boards, supply lines and the like.

BACKGROUND

Some considerations when selecting power semiconductor modules are simple manipulability and assembly. Modern module housing designs use, for example, special press-fit technology to connect modules both to a printed circuit board and to a heat sink, for example in a single production step. Only a single screw, for example, is required for such connections. Such press-fit connections therefore provide a high-quality alternative to known soldered connections and therefore meet the requirements of modern power converter designs in a power range up to 55 kW. Such power semiconductor modules can be used in a wide variety of universal drives, variable-frequency drives, uninterruptible power supplies (UPS), inductive heating and welding systems as well as in wind power installations, solar installations and air-conditioning systems.

Module housings suitable for such press-fit technology have specially shaped, deformable press contact elements ("press-fit" pins) which are pressed into corresponding contact holes in a printed circuit board when assembling the module. The press-fit force is generated by tightening a single screw. The press contact elements in the contact holes in the printed circuit board are plastically deformed by tightening the screw. A gas-tight contact zone which is very robust with respect to environmental influences is produced.

Alternatively, modules can be pressed into printed circuit boards and fastened to the heat sink independently of the press-fit operation using screws or other means (before or after they are pressed into the printed circuit board). Power semiconductor modules have hitherto only been pressed into printed circuit boards as a whole. Other connection elements, for example low-inductance strip conductor pairs (also so-called "busbars") are contact-connected in another manner (for example screwed).

However, before assembling the printed circuit board and module, it must be ensured that the press contact elements are not deformed. Otherwise problems may arise during assembly. Furthermore, the press contact elements on the module housing are connection elements which are geometrically relatively complicated to produce. The press-fit contacts often cannot be released and reconnected without a relatively large amount of effort on account of the remaining deformation of the contact elements on the module.

SUMMARY

The embodiments described herein enable power electronic modules to be removed after the modules are mounted on a heat sink and a busbar or a printed circuit board has been contact-connected using press-fit technology. In this case, the heat sink and the busbar or the printed circuit board remain in position and the module connections to the cooler and to the busbar or to the printed circuit board can be released so that the module can be pulled out.

According to an embodiment, a press-fit connecting element for being pressed into a first contact opening in a first connection element and into a second contact opening in a second connection element is provided. The press-fit connecting element includes an elongated base body configured to be guided through the second contact opening in the second connection element to the first contact opening in the first connection element. The press-fit connecting element also includes a first press-fit zone configured to contact-connect the first contact opening in a force-fitting manner and a second press-fit zone which is at a distance from the first press-fit zone in a longitudinal direction and configured to contact-connect the second contact opening in a force-fitting manner.

According to an embodiment, a connecting system for electronic modules includes an electronic module having at least one first connection element with at least one first contact opening, at least one external connection element with a second contact opening and at least one press-fit connecting element. The press-fit connecting element has an elongated base body configured to be guided through the second contact opening in the external connection element to the first contact opening in the first connection element of the electronic module. The press-fit connecting element also has a first press-fit zone configured to contact-connect the first contact opening in a force-fitting manner and a second press-fit zone which is at a distance from the first press-fit zone in a longitudinal direction and configured to contact-connect the second contact opening in a force-fitting manner. External connection elements may be formed, for example, by a printed circuit board or a low-inductance strip conductor pair.

Those skilled in the art will recognize additional features and advantages upon reading the following detailed description, and upon viewing the accompanying drawings.

BRIEF DESCRIPTION OF THE FIGURES

The elements of the drawings are not necessarily to scale relative to each other. Like reference numerals designate corresponding similar parts. The features of the various illustrated embodiments can be combined unless they exclude each other. Embodiments are depicted in the drawings and are detailed in the description which follows.

FIG. 1*a* diagrammatically shows a power semiconductor module having press-fit pins for contact-connection to a printed circuit board.

FIG. 1*b* shows another module in which the press-fit operation and mounting on the heat sink take place separately.

FIG. 3 shows a side view of an example of a connecting element having two press-fit zones for being pressed into a module connection element as well as a printed circuit board, a perforated strip conductor or the like.

FIG. 10 shows the connecting elements from FIG. 3 on a carrier having a pressing-out apparatus.

DETAILED DESCRIPTION

Figure 2:
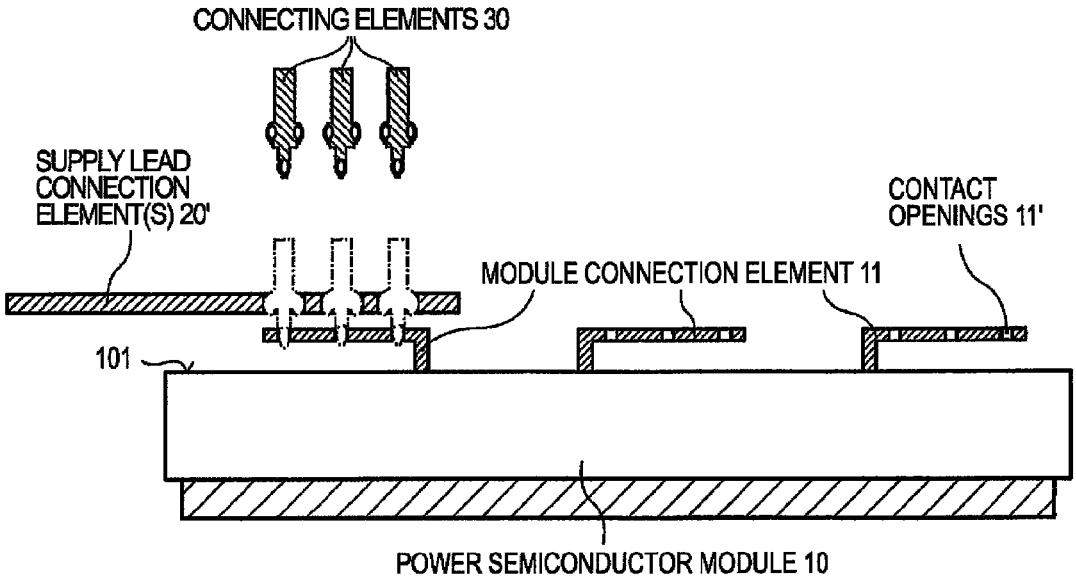
FIG. 2 diagrammatically shows a side view of a system for connecting an electronic module and corresponding connection elements with the aid of press-fit connecting elements.

FIG. 1*a* diagrammatically shows a power semiconductor module 10 having a plurality of press-fit pins 30 for contact-connection to a printed circuit board 20. In the example illustrated, the module 10 is pressed into the printed circuit board 20 with the aid of a screw 40 and is simultaneously tightly screwed to a heat sink 11. The press-fit pins 30 are pressed into corresponding contact holes in the printed circuit board 20 by the force exerted on the module 10 during the screwing-in operation. FIG. 1*b* illustrates a perspective view of another module 10 having the press-fit pins 30 arranged on the module housing, but without a printed circuit board. This module is first screwed to the heat sink and can then be independently pressed into a printed circuit board. The press-fit connecting system illustrated in FIG. 1 is described, inter alia, in the article by T. Stolze, M. Thoben, M. Koch, R. Severin: *Reliability of pressFIT connections*, in: Proceedings of PCIM Europe 2008.

FIG. 2 diagrammatically shows a side view of a connecting system for electronic modules according to an embodiment for reliably electrically contact-connecting the modules. This embodiment relates to a power semiconductor module 10 having at least one module connection element 11, e.g. a plurality of module connection elements 11 as shown, which are arranged on an outer side of the module housing. The connection elements 11 are formed, for example, from a piece of flat conductor (conductor in the form of a strip with an approximately rectangular cross section) which is guided out of the module in a manner perpendicular to the surface 101 of the module housing and is bent through 90° outside the module, with the result that part of the flat conductor is parallel to the housing surface 101 of the module 10. One or more contact openings 11' (for example through-holes) are respectively provided in these sections of the module connection elements 11 which are parallel to the housing surface 101.

A connection element outside the module may be associated with one or more module connection elements 11, this connection element outside the module e.g. being a printed circuit board 20 as shown in FIG. 1*a* (such as a printed circuit card) or a further flat or strip conductor 20' (such as a busbar) and likewise having contact openings which correspond to the contact openings 11' in the module connection elements 11.

A reliable electrical connection between the electronic module 10 and the external connection element (for example the printed circuit board 20) or the external connection elements is ensured by press-fit connecting elements 30 which can be pressed into the contact openings in the external connection element(s). Each press-fit connecting element 30 is pressed into two corresponding openings.

Figure 3:
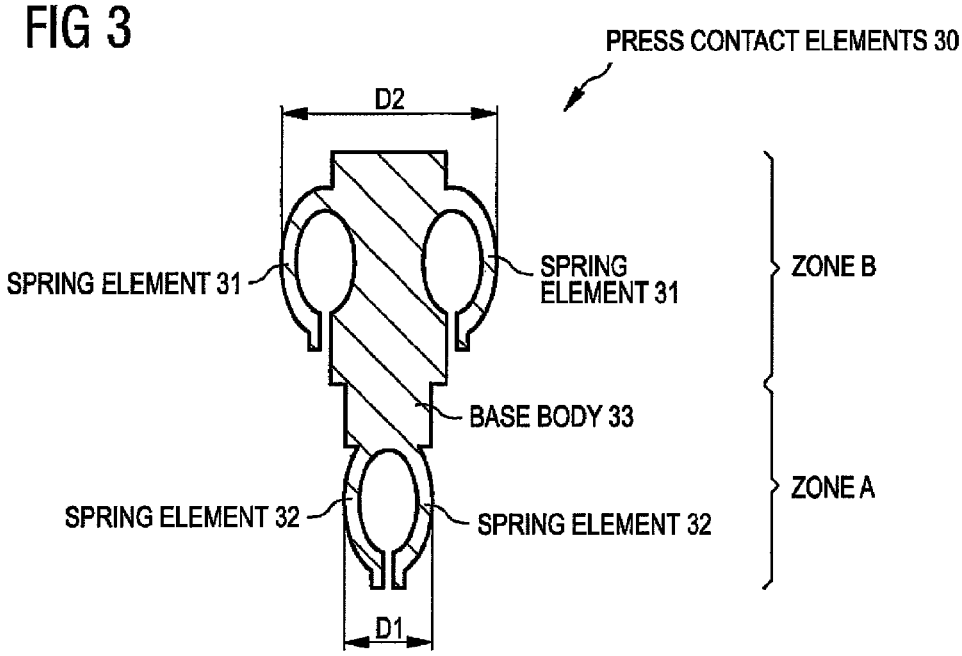

FIG. 3 illustrates an example of a press-fit connecting element 30 according to an embodiment. The press-fit connecting element 30 shown in FIG. 3 comprises an elongated (in the longitudinal direction) base body 33 having two press-fit zones A and B which are at a distance from one another in the longitudinal direction. According to one embodiment, the maximum external dimension D1 of the press-fit zone A (measured perpendicular to the longitudinal direction) is less than the maximum external dimension D2 of the press-fit zone B. The base body 33 may also have further press-fit zones (not illustrated) at a distance from the press-fit zones A and B in the longitudinal direction.

To facilitate the operation of pressing the press-fit zones A and B into the corresponding contact openings, the press-fit connecting element 30 may have spring elements 31, 32 in the region of the press-fit zones. The spring elements 31, 32 are configured in such a manner that they are elastically and/or plastically deformed when pressed into the corresponding contact openings and exert a contact force on the inside of the contact openings. For this purpose, the spring elements 31, 32 may have, for example, an eyelet, fork or spiral shape or any other, easily deformable geometry. As an alternative, the contact openings (for example contact openings 11' in the module connection elements 11) could be elastically and/or plastically deformable. In this case, the press-fit connecting element 30 may have a full geometry with a square or round cross section, for example. In any case, the respective contact zone (zone A or B) and the corresponding contact opening in the respective connection element (see FIG. 2, module connection element 11 and supply lead connection element 20') are matched to one another in such a manner that a reliable force-fitting connection (and consequently also reliable, low-impedance electrical contact) is ensured.

The contact zones of the press-fit connecting elements 30 may be very different. In addition to the slotted eyelet shape shown in FIGS. 1 and 3, the contact zones may also have other suitable shapes, for example a spiral which forms the contact zone, a star-shaped or X-shaped contact zone, etc.

The electronic module 10 may contain semiconductor switches, for example one or more power transistor half bridges for constructing a power converter. In this case, a reliable, low-impedance electrical connection of the load connections of the power semiconductors is desirable. In order to keep the power inductances as low as possible (and in order to thus avoid the disadvantages of high power inductances when switching high load currents), the external supply lead connection elements 20' can be in the form of parallel striplines or strip conductors (strip conductor pairs) in which the same load current respectively flows in an anti-parallel manner. In this case, the strip conductors are guided parallel to the surface 101 of the electronic module housing and at different distances from the housing surface 101.

Figure 4:
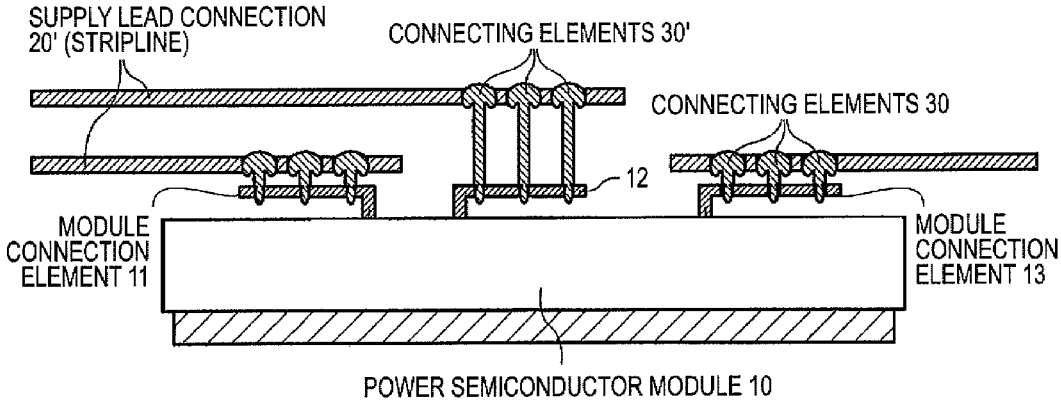
FIG. 4 diagrammatically shows a side view of another system for connecting an electronic module and corresponding connection elements with the aid of press-fit connecting elements.

FIG. 4 illustrates a configuration where the strip conductors 20' are guided parallel to the surface 101 of the electronic module housing and at different distances from the surface 101. Each strip conductor 20' is associated with its own module connection element 11, 12, 13. Connecting elements 30 of different lengths are provided for each strip conductor/connection element pair to compensate for the different distances between the individual strip conductors 20' and the surface 101 of the module housing. Those regions of the strip conductors 20' which are provided with contact openings are offset with respect to one another in the horizontal direction (that is to say in a direction running parallel to the housing surface 101), with the result that a first strip conductor 20' which is further inside (that is to say closer to the module housing) does not impede the insertion of a press-fit connecting element 30 from a second strip conductor 20' which is further outside to the module connection element (e.g. connection element 12 in FIG. 4) associated with the second strip conductor 20'.

Figure 5:
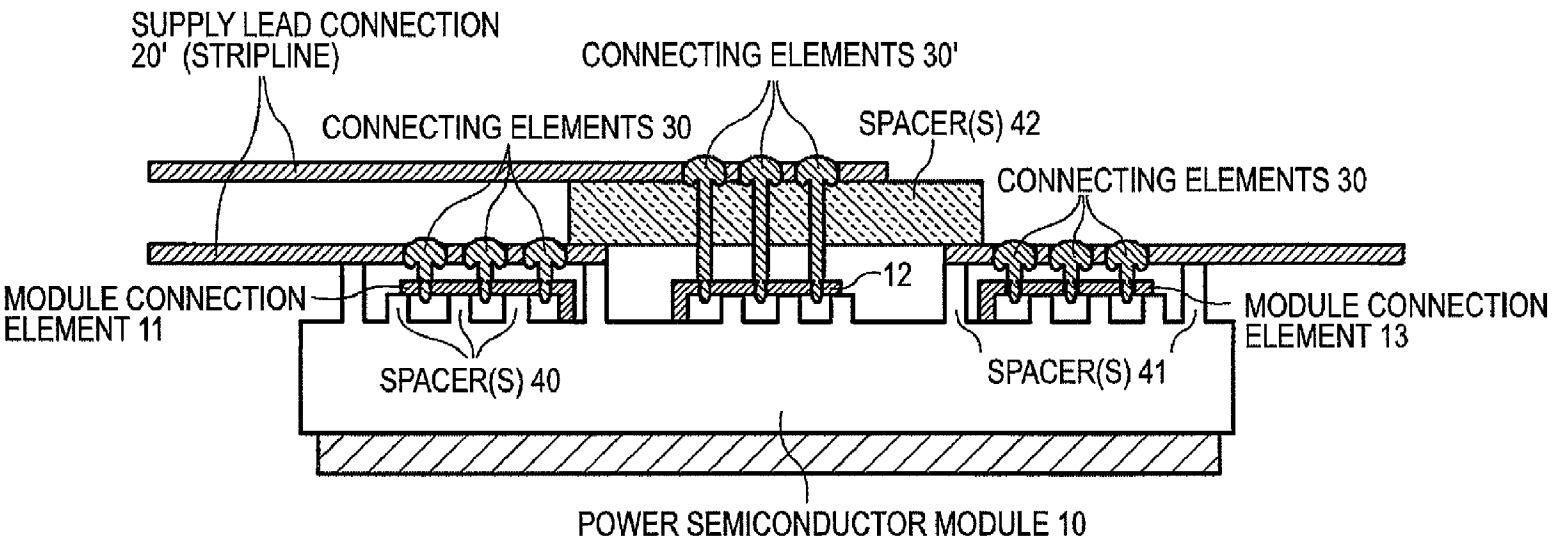
FIG. 5 diagrammatically shows a side view of yet another system for connecting an electronic module and corresponding connection elements with aid of press-fit connecting elements.

FIG. 5 shows an embodiment for improving the assembly of the press-fit connecting system of FIG. 4 by providing spacers 40, 41, 42 against which the respective connection elements 11, 12, 13 rest. The spacers 40, 41, 42 may be provided on the electronic module 10, more precisely on the surface 101 of the module housing, and/or between the connection elements 11, 12, 13, 20, 20'.

The spacers 40, 41, 42 form abutments for the connection elements 11, 12, 13. The first set of spacers 40 are used as abutments for the module connection elements 11, 12, 13 which emerge from the surface 101 of the module housing in a perpendicular manner and are angled through 90° outside the module 10, with the result that a limb of a connection element 11, 12, 13 runs parallel to the housing surface 101. The contact openings (for example punched holes) into which the press-fit connecting elements 30 are pressed during assembly are also arranged in these limbs of the module connection elements 11, 12, 13 which run parallel to the housing surface 101.

The first set of spacers 40 prevent those parts of the connection elements 11, 12, 13 which run parallel to the surface 110 of the electronic module 10 from being bent when pressing in a press-fit connecting element 30, the spacers bridging the space between the surface 110 and the connection element 11, 12, 13, with the result that the connection element practically rests against the module housing. In this case, the spacers 40 may be an integral part of the module housing. However, the spacers 40 are not intended to cover the contact openings (for example contact opening 11'), with the result that a connecting element 30 can be inserted through the contact opening in question without any problems.

The second set of spacers 41 are used as supports for the external connection elements 20, 20' or else for a printed circuit board 20 (e.g. see FIG. 1). The second set of spacers 41 are somewhat longer than the first set of spacers 40, with the result that the external connection elements 20, 20' come to lie somewhat above the associated module connection elements 11, 13. The difference in length (measured perpendicular to the housing surface 101) between the first and second set of spacers 40 and 41 corresponds approximately to the distance between the two press-fit zones A and B of an appropriate press-fit connecting element 30 (e.g. see FIG. 3). If, as already illustrated in FIG. 4, a plurality of external connection elements (printed circuit boards 20 or strip conductors 20') are intended to be connected to the electronic module 10, the connection element 20' closest to the surface 101 of the module housing is mounted on the second set of spacers 41 and the further external connection elements 20' lying above it are mounted on the respective connection element (for example strip conductor 20') lying below them via at least one third spacer 42, thus resulting in a stack of connection elements and spacers (spacer 41, first external connection element 20', spacer 42, second external connection element 20', etc.). If appropriate, the spacers (e.g. spacer 42 in FIG. 5) may have through-openings through which the press-fit connecting elements 30 are guided in the assembled state.

Strip conductor pairs 20' which run parallel to one another at a very short distance from one another are particularly important in this context. Such strip conductor pairs 20' are at such a short distance that the inductance of the strip conductor pair is greatly reduced in comparison with individual conductors in the case of currents flowing in an anti-parallel manner. A thin insulation layer can be arranged between the two strip conductors in a strip conductor pair. The distance between two strip conductors is usually less than a row of strip conductors.

Figure 6:
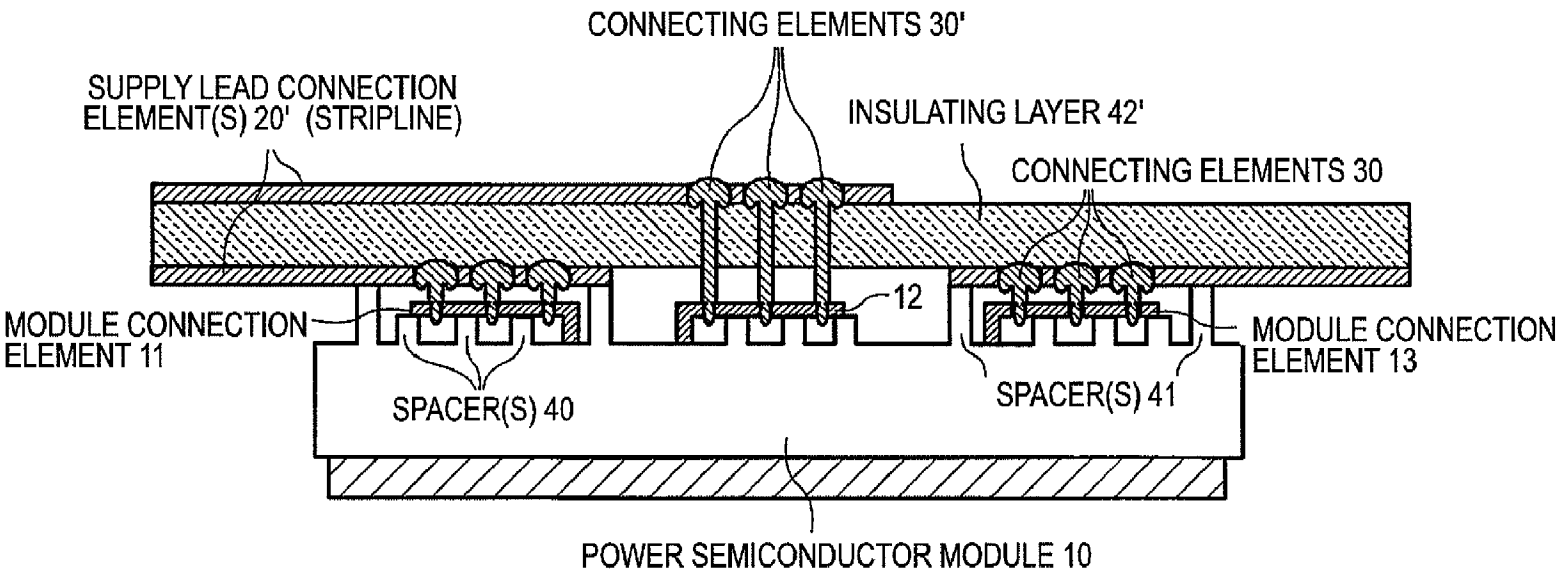
FIG. 6 shows a similar system to FIG. 5 with an insulating layer through which the connecting elements are guided and arranged between two connection elements lying above one another.

FIG. 6 shows an insulation layer 42' such as a film between two strip conductors 20' (strip conductor pair) guided in a parallel manner. The insulation layer 42' can assume the function of the third spacer 42 shown in FIG. 5. To contact-connect the strip conductor 20' arranged on that side of the insulating layer 42' which faces away from the module 10 to the corresponding module connection element 12, the insulating layer 42, 42' has through-holes aligned with the contact openings and through which the press-fit connecting elements 30' are guided in the assembled state.

Figure 7:
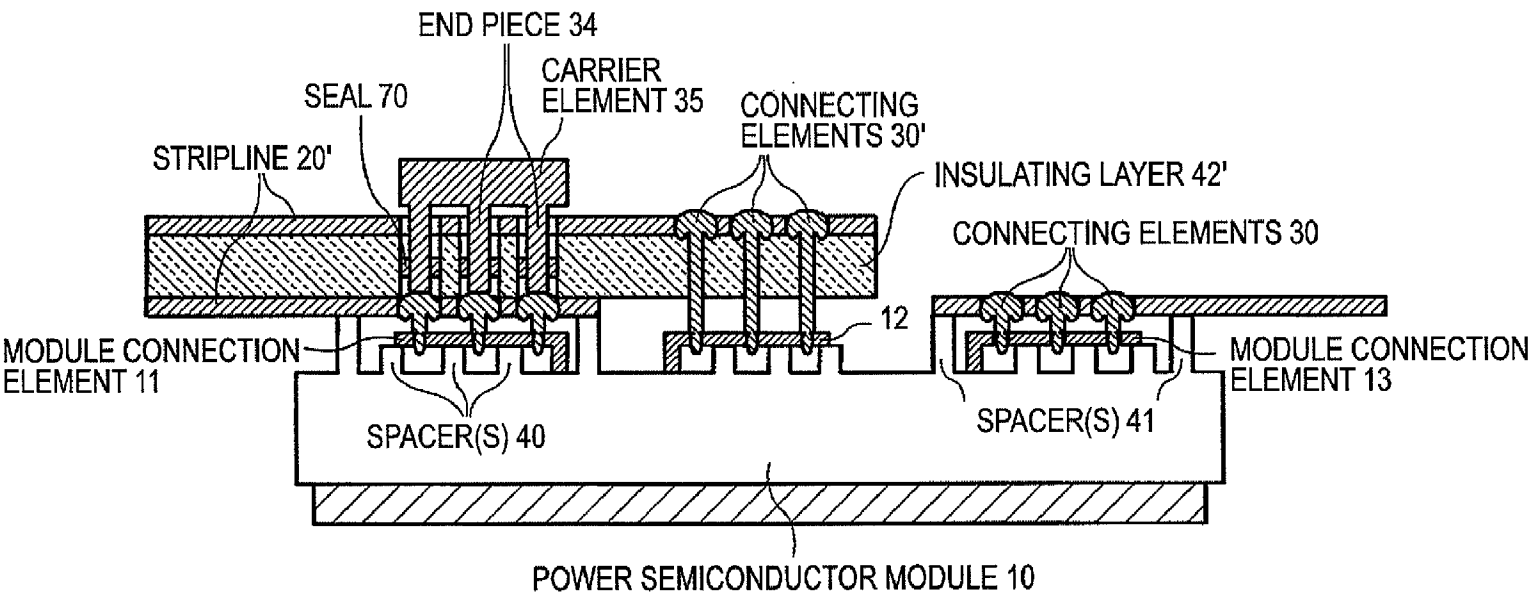
FIG. 7 shows a similar system to FIG. 6 with a plurality of connecting elements arranged on an insulating carrier element guided through the insulating layer and bushings sealed with an insulating material.

FIG. 7 illustrates another embodiment of a press-fit connecting system. The system illustrated in FIG. 7 is an alternative to the embodiments shown in FIGS. 5 and 6. To simplify the assembly of the electronic module 10 and the connection elements 11, 12, 13, 20, 20' when using at least two-layer strip conductors (strip conductor pairs), the press-fit connecting elements 30 may be provided, at one end, with an elongated end piece 34 made of an insulating material. In this case, the elongated end pieces 34 have similar external dimensions (transverse to the longitudinal direction) to the press-fit connecting elements 30 themselves, with the result that the press-fit connecting elements 30 can be inserted, with the end pieces 34, through one or more layers of strip conductors (e.g. separated by insulating layers 42') at a different potential in order to contact-connect the lowermost strip conductor of the strip conductors 20' to a corresponding module connection element 11 without short-circuiting the strip conductor with the strip conductors lying above it. To ensure reliable insulation, a seal 70 is arranged in the space between the insulating layer 42', which separates the two strip conductors 20' in a strip conductor pair, and the corresponding press-fit connecting elements 30. In one embodiment, an O-ring is used as the sealing element 70.

To manipulate and simultaneously press in a plurality of press-fit connections in a simpler manner during assembly, a plurality of press-fit connecting elements 30 may be fastened to a carrier 35, if appropriate via the end pieces 34. A carrier 35 then carries a plurality of press-fit connecting elements 30 (for example all press-fit connecting elements needed to contact-connect a module connection element 11), with the result that the press-fit connecting elements can be pressed in together.

In the previously described embodiments, the connection elements 11, 12, 13 of the electronic module 10 are guided to the outside through a surface 101 of the module housing. In the embodiments shown in FIGS. 8 and 9, the module connection elements are arranged directly on a substrate 11 on the "base" of the electronic module 10 and are accessible from the outside through an opening in the module housing.

Figure 8:
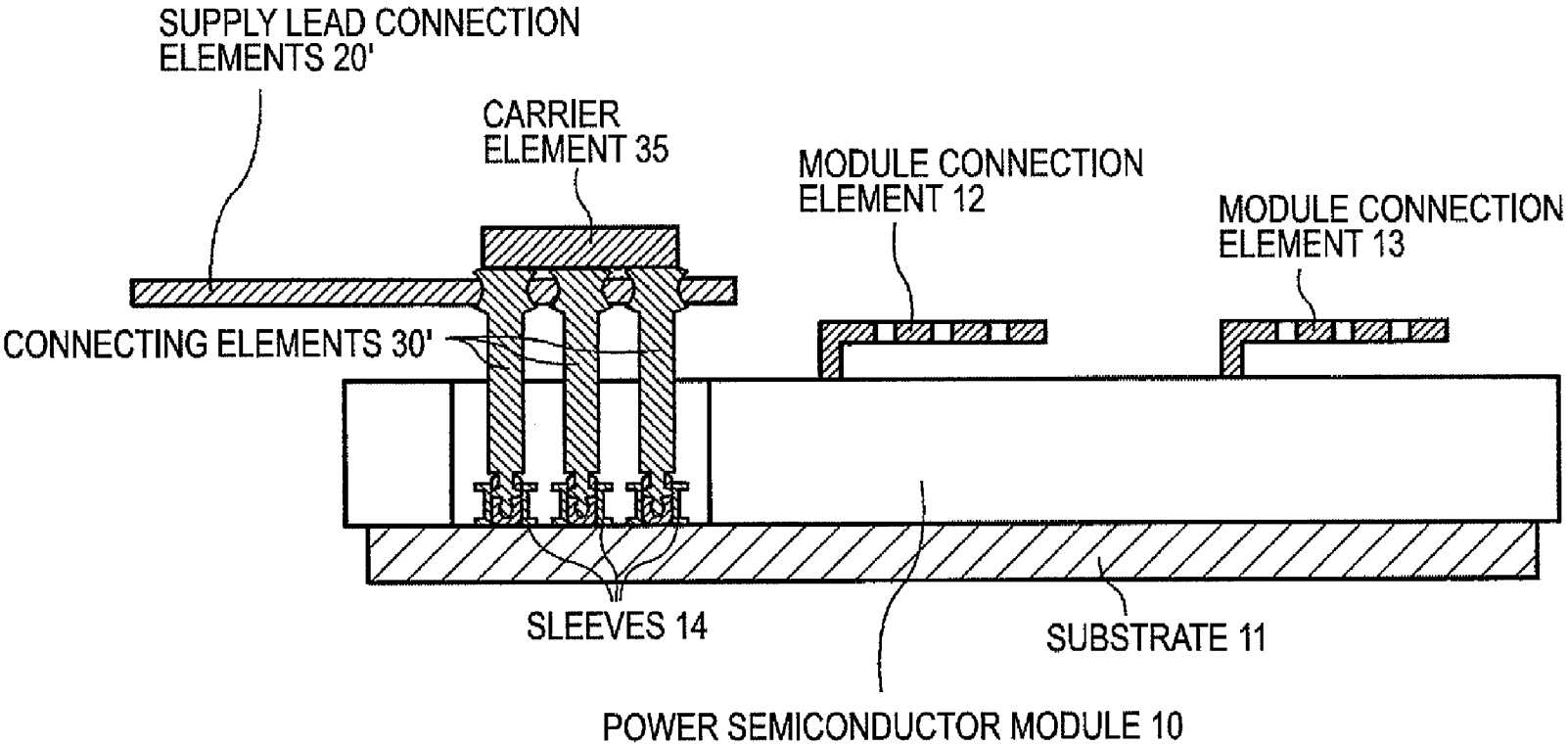
FIG. 8 shows a similar system to FIG. 2 with the connection elements on the module side being in the form of sleeves and arranged on the substrate.
Figure 9:
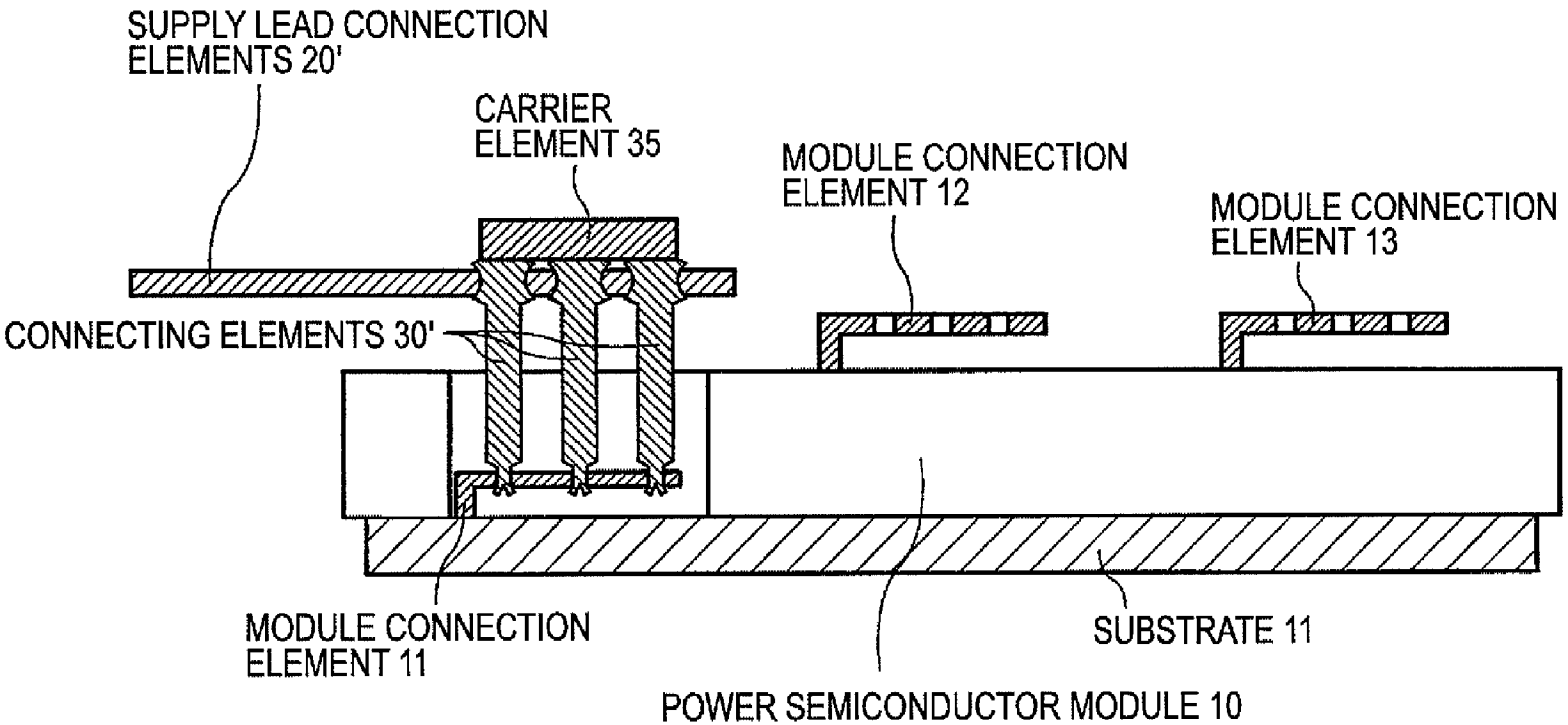
FIG. 9 shows a similar system to FIG. 8 with the connection elements on the module side being in the form of perforated connection elements and formed on the substrate.

In FIG. 8, the module connection elements are in the form of sleeves 14 into which press-fit connecting elements 30 can be pressed. In this case, the inner wall of the contact opening formed by a sleeve 14 and a corresponding press-fit zone A of the relevant press-fit connecting element form a force-fitting connection and thus also a reliable, low-impedance electrical connection. As an alternative to the sleeves shown in FIG. 8, connection elements 11 which are in the form of strips (e.g. see FIGS. 2 and 4-7) and have contact openings 11' may also be directly fastened to the substrate 11 on the base of the module 10. As illustrated in FIG. 9, the press-fit connecting elements 30 engage in the contact openings in the connection elements 11 and form a force-fitting connection.

FIG. 10 shows another embodiment of the carrier element 35 from FIGS. 7-9. Like the carrier element 35 in the embodiments shown in FIGS. 7-9, the carrier element 36 carries at least one press-fit connecting element 30. However, at least one lever 37 is connected to the carrier element 36. The lever 37 can be used to easily release again the press-fit connecting elements 30 which were previously pressed in. Release is affected by virtue of the lever 37 which is used to produce a force between the connection element 11 (into which the press-fit connecting elements 30 have been pressed) and the carrier element 36. Since the press-fit connecting elements 34 are fastened to the carrier element, the press-fit connecting elements 30 are pulled out of the contact holes in the connection element.

Spatially relative terms such as "under", "below", "lower", "over", "upper" and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

It is to be understood that the features of the various embodiments described herein may be combined with each other, unless specifically noted otherwise.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A connecting system for electronic modules, comprising:

an electronic module having a housing and including a first conductive connection element emerging from the housing and having a first contact opening;

an external connection element having a second contact opening; and a press-fit connecting element including an elongated base body configured to be guided through the second contact opening in the external connection element to the first contact opening in the first conductive connection element of the electronic module, the press-fit connecting element having a first press-fit zone configured to contact-connect the first contact opening in a force-fitting manner and a second press-fit zone which is at a distance from the first press-fit zone in a longitudinal direction and configured to contact-connect the second contact opening in a force-fitting manner.

2. The connecting system as claimed in claim 1, further comprising a carrier element on which the press-fit connecting element is arranged and fastened so that the carrier element rests against the external connection element after the press-fit connecting element is pressed into place.

3. The connecting system as claimed in claim 2, wherein a lever is articulated to the carrier element, the lever configured to exert a force on the external connecting element when the press-fit connecting element is pressed into place, the force acting in the longitudinal direction of the press-fit connecting element to prevent the press-fit connecting element from being pulled out of the first contact opening in the first connection element of the electronic module.

4. The connecting system as claimed in claim 1, wherein the external connection element is a printed circuit board, a strip conductor or a strip conductor pair.

5. The connecting system as claimed in claim 1, wherein at least one of the connection elements rests against a spacer connected to the housing of the electronic module.

6. The connecting system as claimed in claim 1, wherein the external connection element comprises at least two strip conductors, the strip conductors running parallel to one another and each being separated from one another by an insulating layer or a spacer, the strip conductors having ends which are offset with respect to one another and have contact holes, wherein the electronic module has first and second connection elements which are each associated with a strip conductor and each have contact holes corresponding to the contact holes in the strip conductors, and wherein the press-fit connecting element connects each of the strip conductors to a corresponding connection element.

7. The connecting system as claimed in claim 1, wherein the first connection element of the electronic module is fastened to a substrate on a base of the module, and the press-fit connecting element is guided through the module housing from a top side of the module to the first connection element.

8. The connecting system as claimed in claim 1, wherein a plurality of press-fit connecting elements are arranged on a common carrier and connected to the common carrier.

9. The connecting system as claimed in claim 8, wherein the common carrier comprises a lever configured to release the press-fit connecting elements.

10. A connecting system for electronic modules, comprising:

an electronic module having a housing and including a first conductive connection element disposed inside the housing and having a first contact opening;

an external connection element having a second contact opening; and a press-fit connecting element including an elongated base body configured to be guided through the second contact opening in the external connection element to the first contact opening in the first conductive connection element of the electronic module, the press-fit connecting element having a first press-fit zone configured to contact-connect the first contact opening in a force-fitting manner and a second press-fit zone which is at a distance from the first press-fit zone in a longitudinal direction and configured to contact-connect the second contact opening in a force-fitting manner.

* * * * *